US008882994B2

(12) United States Patent
Moser et al.

(10) Patent No.: US 8,882,994 B2
(45) **Date of Patent: *Nov. 11, 2014**

(54) COUNTER-CURRENT CATALYST FLOW WITH SPLIT FEED AND TWO REACTOR TRAIN PROCESSING

(75) Inventors: Mark D. Moser, Des Plaines, IL (US); David A. Wegerer, Des Plaines, IL (US); Kurt M. VandenBussche, Des Plaines, IL (US); Manuela Serban, Des Plaines, IL (US); Mark P. Lapinski, Des Plaines, IL (US); Mary Jo Wier, Des Plaines, IL (US); Gregory J. Gajda, Des Plaines, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/327,164

(22) Filed: Dec. 15, 2011

(65) Prior Publication Data

US 2013/0158319 A1 Jun. 20, 2013

(51) Int. Cl.
*C10G 35/04* (2006.01)

(52) U.S. Cl.
USPC ..... 208/134; 208/133; 208/79; 208/80; 585/319

(58) Field of Classification Search
CPC ..... C10G 35/00; C10G 35/04; C10G 59/06
See application file for complete search history.

(56) References Cited

U.S. PATENT DOCUMENTS

| | | | | | |
|---|---|---|---|---|---|
| 2,324,165 | A | * | 7/1943 | Layng et al. | 208/79 |
| 2,698,829 | A | * | 1/1955 | Haensel | 208/60 |
| 2,866,745 | A | * | 12/1958 | Heinemann | 208/79 |
| 2,956,005 | A | * | 10/1960 | Lutz et al. | 208/96 |
| 3,647,680 | A | * | 3/1972 | Greenwood et al. | 208/65 |
| 4,401,554 | A | * | 8/1983 | Choi et al. | 208/64 |
| 6,004,452 | A | * | 12/1999 | Ash et al. | 208/80 |
| 6,602,404 | B2 | * | 8/2003 | Walsh et al. | 208/134 |

OTHER PUBLICATIONS

Netzer et al. Improve Benzene Production from Refinery Sources. Hydrocarbon Processing. 2002, pp. 71-72.*
U.S. Appl. No. 13/327,200, filed Dec. 15, 2011, Moser et al.
U.S. Appl. No. 13/327,143, filed Dec. 15, 2011, Moser et al.
U.S. Appl. No. 13/327,212, filed Dec. 15, 2011, Moser et al.
U.S. Appl. No. 13/327,220, filed Dec. 15, 2011, Moser et al.
U.S. Appl. No. 13/327,185, filed Dec. 15, 2011, Serban et al.
U.S. Appl. No. 13/327,178, filed Dec. 15, 2011, Serban et al.
U.S. Appl. No. 13/327,170, filed Dec. 15, 2011, Serban et al.
U.S. Appl. No. 13/327,192, filed Dec. 15, 2011, Serban et al.

* cited by examiner

*Primary Examiner* — Walter D Griffin
*Assistant Examiner* — Jelitza Perez
(74) *Attorney, Agent, or Firm* — Arthur E Gooding

(57) ABSTRACT

A process is presented for the increasing the yields of aromatics from reforming a hydrocarbon feedstream. The process includes splitting a naphtha feedstream into a light hydrocarbon stream, and a heavier stream having a relatively rich concentration of naphthenes. The heavy stream is reformed to convert the naphthenes to aromatics and the resulting product stream is further reformed with the light hydrocarbon stream to increase the aromatics yields. The process includes passing a catalyst stream in a counter-current flow relative to the hydrocarbon process stream.

14 Claims, 2 Drawing Sheets

COUNTER-CURRENT CATALYST FLOW WITH SPLIT FEED AND TWO REACTOR TRAIN PROCESSING

FIELD OF THE INVENTION

The present invention relates to the process of enhancing the production of aromatic compounds. In particular the improvement and enhancement of aromatic compounds such as benzene, toluene and xylenes from a naphtha feedstream.

BACKGROUND OF THE INVENTION

The reforming of petroleum raw materials is an important process for producing useful products. One important process is the separation and upgrading of hydrocarbons for a motor fuel, such as producing a naphtha feedstream and upgrading the octane value of the naphtha in the production of gasoline. However, hydrocarbon feedstreams from a raw petroleum source include the production of useful chemical precursors for use in the production of plastics, detergents and other products.

The upgrading of gasoline is an important process, and improvements for the conversion of naphtha feedstreams to increase the octane number have been presented in U.S. Pat. Nos. 3,729,409, 3,753,891, 3,767,568, 4,839,024, 4,882,040 and 5,242,576. These processes involve a variety of means to enhance octane number, and particularly for enhancing the aromatic content of gasoline.

In addition, the production of aromatics is important. Aromatics, such as benzene, are used in plastics production and the production of detergents. Increasing the yields of aromatic compounds from hydrocarbons streams increases the return, as lower value hydrocarbons are converted to higher value aromatics.

Processes include splitting feeds and operating several reformers using different catalysts, such as a monometallic catalyst or a non-acidic catalyst for lower boiling point hydrocarbons and bi-metallic catalysts for higher boiling point hydrocarbons. Other improvements include new catalysts, as presented in U.S. Pat. Nos. 4,677,094, 6,809,061 and 7,799,729. However, there are limits to the methods and catalysts presented in these patents, and which can entail significant increases in costs.

The increased demand generates pressure for more efficient production of desired products of hydrogen, aromatics and liquid C5+ hydrocarbons from transforming naphtha, and to reduce the waste or by-product formation. Increase efficiency also demands improving the throughput to reforming units. More efficient schemes are possible.

SUMMARY OF THE INVENTION

The present invention comprises controlling the process and catalyst flow to improve the yields of aromatics from a naphtha feedstock. The process includes passing a hydrocarbon feedstock to a fractionation unit to create a first overhead stream and a first bottoms stream. The first bottoms stream is passed to a first reformer reactor system. The first reformer reactor system is operated at a first set of reforming operating conditions to increase the aromatic content in a first effluent stream from the first reforming reactor system. The first reformer reactor system uses a catalyst that is appropriate for converting naphthenic compounds to aromatics, as well as dehydrogenating and cyclization of the paraffinic compounds. The first effluent stream and the first overhead stream are combined and passed as a feed to a second reforming reactor system. The second reforming reactor system is operated at a second set of reforming reaction conditions to convert the paraffinic compounds to aromatics and to generate a second effluent stream. The second reforming reactor system is operated to minimize the temperature drop in the reaction system.

The process also includes operation of the reactor systems using moving bed reactors. A regenerated catalyst stream is passed to the second reactor system and generates a second reactor system catalyst effluent stream. The second reactor system catalyst effluent stream is passed to the first reactor system, and generates a first reactor system catalyst effluent stream. The first reactor system catalyst effluent stream comprises spent catalyst, and the spent catalyst is passed to a regenerator to regenerate the catalyst for reuse.

The process also include passing the second reactor effluent stream to a reformate splitter to generate a second overhead stream comprising C7 and lighter aromatics, and a second bottoms stream comprising C8 and heavier aromatics. The second overhead stream is passed to an aromatics recovery unit to generate a product stream having benzene and toluene. The aromatics recovery unit also generates a raffinate stream having non-aromatic compounds. The raffinate stream can be passed to the second reforming reactor system for further conversion.

Other objects, advantages and applications of the present invention will become apparent to those skilled in the art from the following drawings and detailed description of the invention.

DETAILED DESCRIPTION OF THE INVENTION

A process is presented for addressing the need to increase the yields of benzene, toluene and xylenes from a hydrocarbon feedstream. The hydrocarbon feedstream is usually a full boiling range naphtha feedstream and the naphtha feedstream is reformed to generate C6 to C10 aromatics. The reformation process involves a catalytic reactor to selectively convert naphthenes and paraffins to aromatic compounds. In general, catalytic reforming generates unwanted byproducts, which include methane, ethane and to a lesser degree propanes and butanes. These are low value products and processes that reduce the formation of these byproducts and increase the amount of aromatics improves the economics of the reforming process. Optimization of catalyst usage and process flow can provide significant improvements.

Catalytic reforming of hydrocarbons proceeds through numerous chemical reaction pathways. The reforming reaction rates vary with temperature, and different compounds within the hydrocarbon stream have different reaction activation energies. The reaction rates are therefore affected differently by different reaction temperatures for the different components. In the case of catalytic reforming there are numerous parallel reaction pathways, or competing reaction pathways. With different activation energies, it is possible to manipulate the conversion rates to desired products by controlling the reaction temperatures. However, since there are a large number of parallel reactions, the control is limited to classes, or types, of chemical compounds being reformed, and the control is over the ability to sufficiently segregate the classes of compounds. In the case of naphtha, the catalytic reforming process is endothermic overall. For an adiabatic reaction system, there is a substantial temperature decrease and this adversely affects the rates of conversion. By segregating the most endothermic compounds, and reforming the more endothermic compounds, the temperatures of the reactions are more easily controlled, and the yields can be increased. This also has a benefit of reducing the selectivity of undesired side products. In general, the separation is to create a light hydrocarbon stream having a relatively low concentration of naphthenic compounds and a heavier hydrocarbon stream having a relatively high concentration of naphthenic compounds. The separate streams are processed in conjunction with directing the catalyst streams to maximize aromatic yields.

Figure 1:
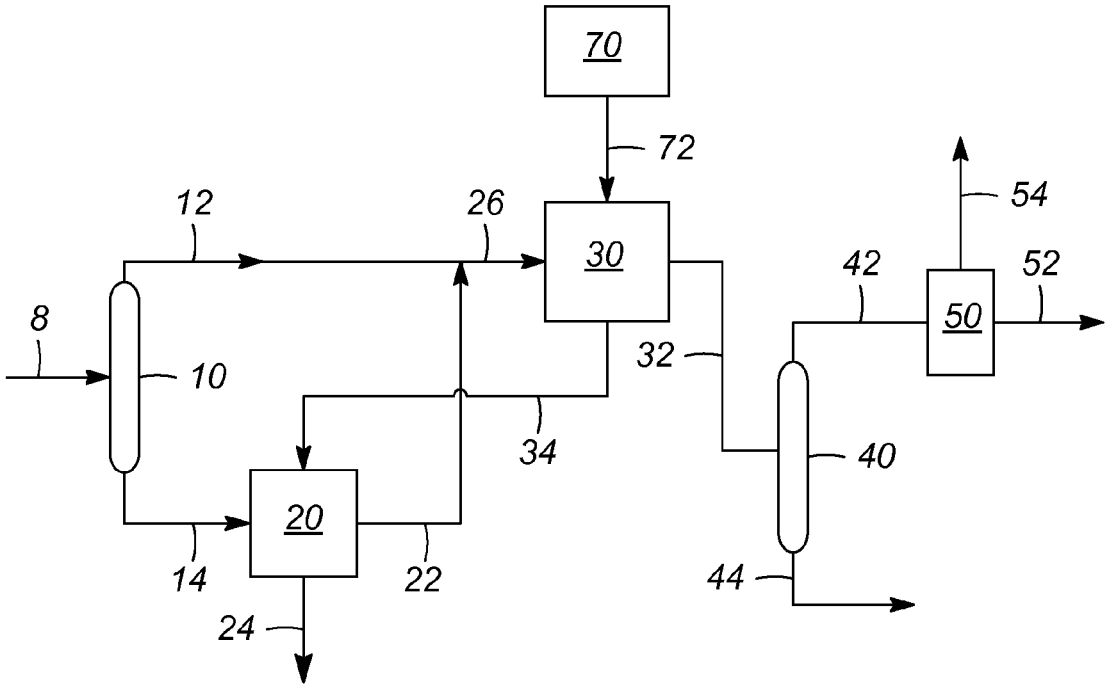
FIG. 1 is a diagram of the flow process for enhanced aromatics production.

Improving the catalysts has been the main focus of improving the reforming process, however, modifying the process using non-obvious rearrangements can yield unexpected results. The present invention for reforming a hydrocarbon feedstream is shown in FIG. 1.

A process for reforming a hydrocarbon feedstream is presented. The process includes passing a hydrocarbon feedstream 8 to a fractionation system 10 to generate a first overhead stream 12 and a first bottoms stream 14. The first bottoms stream 14 is passed to a first reformer reactor system 20 to generate a first reactor effluent 22, where the effluent has an increased aromatics content and a reduced naphthenes content. The first overhead stream 12 and the first reactor effluent 22 are passed to a second reforming reactor system 30 to generate a second reactor effluent stream 32. The second reactor effluent stream 32 is passed to a reformate splitter 40 to generate a second overhead stream 42 and a second bottoms stream 44. The second overhead stream 42 is passed to an aromatics recovery unit 50 to generate a product stream 52 comprising benzene and toluene, and a raffinate stream 54 comprising non-aromatic hydrocarbon compounds.

The process further includes passing reforming catalyst through the reactor systems 30, 20. Catalyst is regenerated in a regenerator 70 and passes a regenerated catalyst stream 72 to the second reforming reactor system 30. The second reactor system 30 generates a second reactor catalyst effluent stream 34. The second reactor catalyst effluent stream 34 is passed to the first reactor system 20 and generates a first reactor catalyst effluent stream 24. The first reactor catalyst effluent stream is passed to the regenerator 70.

The process can further include passing the feedstream to a hydrotreating unit (not shown) to create a treated hydrocarbon feedstream having a reduced sulfur concentration, and then passing the treated stream to the fractionation unit 10.

In one embodiment, the raffinate stream 54 is passed to the hydrotreating unit to remove residual sulfur generated in the aromatics recovery unit, before passing the raffinate stream to the reforming reactors.

Figure 2:
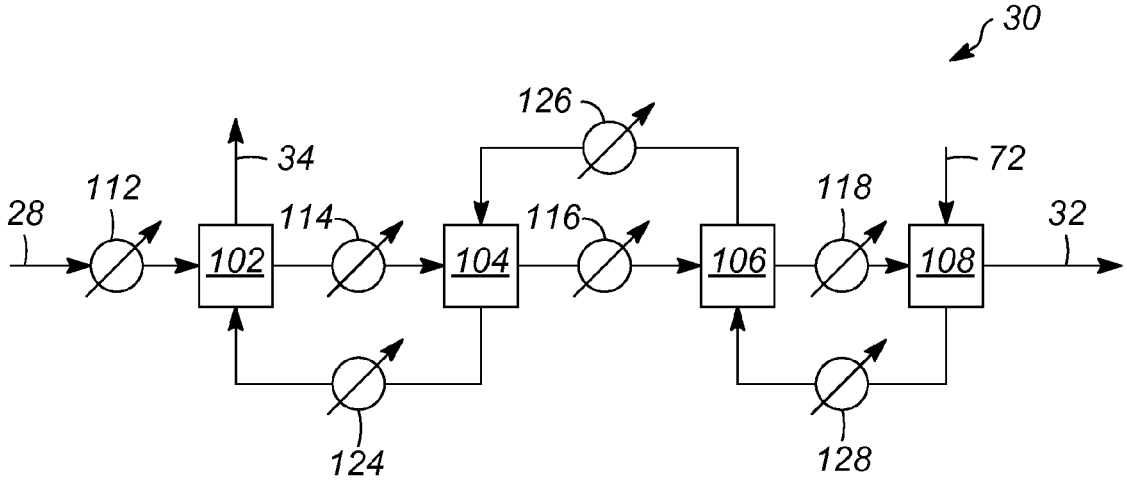
FIG. 2 is a diagram of the flow of catalyst and process streams in the second reactor system.

The second reactor system 30 preferably comprises a plurality of reactors with heaters for bringing the reactor feed to a designated reactor inlet temperatures. When the second reactor system 30 comprises a plurality of reactors, the reactors are in a series arrangement, with the process fluid passing from one reactor to the next in sequence. The catalyst is passed to the last reactor in the series, and the catalyst flows sequentially through the reactors in an opposite direction relative to the process fluid flow. The process of the catalyst flow and process stream flow is shown in FIG. 2.

The second reactor system 30 is operated to be a substantially isothermal system. The system includes inter-heaters to heat the process fluid passing between the reactor to the same inlet temperature of 560° C. For a four reactor system in the second reactor system, the process stream 26 is passed through a first inter-heater 112 and heated to an inlet temperature of 560° C. The heated process stream is passed to a first reactor 102 to generate a first reactor effluent stream. The first reactor effluent stream is heated by a second inter-heater 114 to the inlet temperature. The heated first effluent stream is passed to a second reactor 104 to generate a second reactor effluent stream. The second reactor effluent stream is heated by a third inter-heater 116 to the inlet temperature. The heated second effluent stream is passed to a third reactor 106 to generate a third reactor effluent stream. The third reactor effluent stream is heated by a fourth inter-heater 118 to the inlet temperature. The heated third effluent stream is passed to a fourth reactor 108 to generate a fourth reactor effluent stream 32, which is the second reactor system 30 effluent stream. In this process a regenerated catalyst stream 72 is passed to the fourth reactor 108 and generates a fourth reactor catalyst effluent stream. The fourth reactor catalyst effluent stream is passed to the third reactor 106 and generates a third reactor catalyst effluent stream. The third reactor catalyst effluent stream is passed to the second reactor 104 and generates a second reactor catalyst effluent stream. The second reactor catalyst effluent stream is passed to the first reactor 102 and generates a first reactor catalyst effluent stream. The first reactor catalyst effluent stream is the second reactor system catalyst effluent stream 34 and is passed to the first reactor system 20. The catalyst in the effluent stream 34 can be heated to the first reactor inlet temperature.

Optionally, the catalyst can be heated between reactors in the second reactor system. The added heaters would be used to further control the reactor temperatures. In this optional embodiment, the fourth reactor catalyst effluent stream is passed to an inter-heater, or heat exchanger, 128 to heat the catalyst to the inlet temperature. The heated catalyst is passed to the third reactor 106 and generates a third reactor catalyst effluent stream. The third reactor catalyst effluent stream is passed to an inter-heater, or heat exchanger, 126 to heat the catalyst to the inlet temperature. The heated catalyst is passed to the second reactor 104 and generates a second reactor catalyst effluent stream. The second reactor catalyst effluent stream is passed to an inter-heater, or heat exchanger, 124 to heat the catalyst to the inlet temperature. The heated catalyst is passed to the first reactor 102 and generates a first reactor catalyst effluent stream.

The flow of the catalyst through the reforming process can comprise passing the catalyst in a series relationship through the reactors in the second reforming reactor system, where the catalyst flows in the same direction as the process fluid, relative to the flow between the reactors. The catalyst after passing through the second reactor system is then passed to the first reactor system.

In an alternative, the catalyst can flow counter-current relative to the process flow stream with respect to the flow between the reactors. This allows for the freshest catalyst to be exposed to the process stream having the highest aromatics content and lowest paraffin content, with partially spent catalyst being in contact with a process stream having greater amounts of material to be converted as the catalyst flows from one reactor to the next.

The isothermal reactor system, or second reactor system, utilizes a reforming catalyst and is operated at a temperature between 520° C. and 600° C., with a preferred operating temperature between 540° C. and 560° C., with the reaction conditions controlled to maintain the isothermal reactions at or near 560° C. The inlet temperature to each reactor is preferably at 560° C. A plurality of reactor with inter-reactor heaters provides for setting the reaction inlet temperatures to a narrow range, and multiple, smaller reactors allow for limiting the residence time and therefore limiting the temperature variation across the reactor system 40. The process or reforming also includes a space velocity between 0.6 $hr^{-1}$ and 10 $hr^{-1}$. Preferably the space velocity is between 0.6 $hr^{-1}$ and 8 $hr^{-1}$, and more preferably, the space velocity is between 0.6 $hr^{-1}$ and 5 $hr^{-1}$.

Reforming catalysts generally comprise a metal on a support. Generally, the support can be formed by an oil-drop method or extruded, although other methods can be utilized. The support can include a porous material, such as an inorganic oxide or a molecular sieve, and a binder with a weight ratio from 1:99 to 99:1. The weight ratio is preferably from about 1:9 to about 9:1. The support materials can include, but are not limited to, alumina, magnesia, titania, zirconia, chromia, zinc oxide, thoria, boria, ceramic, porcelain, bauxite, silica, silica-alumina, silicon carbide, clays, crystalline zeolitic aluminasilicates, and mixtures thereof. Porous materials and binders are known in the art and are not presented in detail here. The metals preferably are one or more Group VIII noble metals, and include platinum, iridium, rhodium, and palladium. Typically, the catalyst contains an amount of the metal from about 0.01% to about 2% by weight, based on the total weight of the catalyst. The catalyst can also include a promoter element from Group IIIA or Group IVA. These metals include gallium, germanium, indium, tin, thallium and lead.

The catalyst selected for use should include a low-acidity, or a non-acidic catalyst, and be a catalyst selected for the reforming of C6 and C7 paraffins.

The first reforming reactor system uses the same catalyst, but is operated at a lower temperature and allows for greater temperature swings within the reactor.

The reforming conditions for the first reactor system include an operating temperature between 400° C. and 540° C. A preferred operating temperature is between 400° C. and 480° C. The operating temperature is the inlet temperature, and the residence time in the reactor and the extent of the reaction determines the temperature drop within the reactor. The process is controlled to limit the temperature drop, and can include a plurality of reactors with inter-reactor heaters to bring the reaction temperature back up near the reactor inlet temperature.

The reforming conditions for the second reactor system include an operating temperature greater than 540° C. A preferred operating temperature is between 540° C. and 580° C. The operating temperature is the inlet temperature, and the residence time in the reactor and the extent of the reaction determines the temperature drop within the reactor. The process is controlled to limit the temperature drop, and the preferred system includes a plurality of reactors with inter-reactor heaters to bring the reaction temperature back up near the reactor inlet temperature. The process also has a feed to the second reactor system with a substantial portion of the components with high endothermicity previously reformed to aromatics or other compounds.

Therefore, increases can be achieved through innovative flow schemes that allow for process control of the reactions. While the invention has been described with what are presently considered the preferred embodiments, it is to be understood that the invention is not limited to the disclosed embodiments, but it is intended to cover various modifications and equivalent arrangements included within the scope of the appended claims.

The invention claimed is:

1. A process for reforming a hydrocarbon feedstream, comprising:

passing the feedstream to a fractionation system to create a first overhead stream and a first bottoms stream wherein the first overhead stream has a reduced concentration of C8+ naphthenic compounds;

passing the first bottoms stream to a first reformer reactor system, operated at a first set of reforming conditions to generate a first reactor effluent having an increased aromatic content, wherein the first set of reforming conditions includes a temperature between 400° C. and 480° C.;

passing the first overhead stream and the first reactor effluent stream to form a second feed stream;

passing the second feed stream to a second reforming reactor system operated at a second set of reforming conditions, thereby generating a second effluent stream, wherein the second set of reforming conditions includes a temperature greater than 540° C.;

passing regenerated catalyst to the second reactor system, and generating a second reactor system catalyst effluent stream;

passing the second reactor system catalyst effluent stream to the first reactor system, and generating a first reactor system catalyst effluent stream;

passing the first reactor system catalyst effluent stream to a catalyst regenerator;

passing the second effluent stream to a reformate splitter to generate a second overhead stream comprising C7 and lighter aromatics, and a second bottoms stream comprising C8 and heavier aromatics; and passing the second overhead stream to an aromatics recovery unit, thereby generating an aromatics product stream comprising benzene and toluene, and a raffinate stream comprising non-aromatic hydrocarbons.

2. The process of claim 1 further comprising:

passing the hydrocarbon feedstream to a hydrotreating unit to create a treated hydrocarbon feedstream; and passing the treated hydrocarbon feedstream to the fractionation system.

3. The process of claim 2 further comprising passing a portion of the raffinate stream to the hydrotreating unit.

4. The process of claim 1 wherein the second reforming reactor system comprises a plurality of reactors and inter-reactor heaters.

5. The process of claim 4 wherein the second reforming reactor system includes a catalyst stream that passes between the plurality of reactors in the second reforming reactor system in the opposite direction of the second feed stream.

6. The process of claim 1 wherein the second set of reforming conditions includes a temperature between 540° C. and 580° C.

7. The process of claim 1 wherein the first reforming reactor system comprises a plurality of reactors and inter-reactor heaters.

8. A process for reforming a hydrocarbon feedstream, comprising: passing the hydrocarbon feedstream to a hydrotreating unit to create a treated hydrocarbon feedstream;

passing the treated feedstream to a fractionation system to create a first overhead stream and a first bottoms stream wherein the first overhead stream has a reduced concentration of naphthenic compounds;

passing the first bottoms stream to a first reformer reactor system, operated at a first set of reforming conditions to generate a first reactor effluent having an increased aromatic content, wherein the first set of reforming conditions includes a temperature between 400° C. and 480° C.;

passing the first overhead stream and the first reactor effluent stream to form a second feed stream;

passing the second feed stream to a second reforming reactor system operated at a second set of reforming conditions, thereby generating a second effluent stream, wherein the second set of reforming conditions includes a temperature greater than 540° C.;

passing regenerated catalyst to the second reforming reactor system, and generating a second reactor catalyst effluent stream;

passing the second reforming reactor system catalyst effluent stream to the first reformer reactor system, and generating a first reactor catalyst effluent stream;

passing the first reactor catalyst effluent stream to a catalyst regenerator;

passing the second effluent stream to a reformate splitter to generate a second overhead stream comprising C7 and lighter aromatics, and a second bottoms stream comprising C8 and heavier aromatics; and passing the second overhead stream to an aromatics recovery unit, thereby generating an aromatics product stream comprising benzene and toluene, and a raffinate stream comprising non-aromatic hydrocarbons.

9. The process of claim 8 further comprising passing a portion of the raffinate stream to the hydrotreating unit.

10. The process of claim 8 wherein the second reforming reactor system comprises a plurality of reactors and inter-reactor heaters.

11. The process of claim 10 wherein the second reforming reactor system includes a catalyst stream and the catalyst stream passes between the plurality of reactors in the second reactor system in the opposite direction of the second feed stream.

12. The process of claim 8 wherein the second set of reforming conditions includes a temperature between 540° C. and 580° C.

13. The process of claim 8 wherein the first reforming reactor system comprises a plurality of reactors and inter-reactor heaters.

14. The process of claim 13 wherein the first reforming reactor system includes a catalyst stream and the catalyst stream passes between the plurality of reactors in the first reactor system in the opposite direction of the first bottoms stream.

* * * * *